US009482504B2

(12) United States Patent
Nouguez et al.

(10) Patent No.: US 9,482,504 B2
(45) Date of Patent: Nov. 1, 2016

(54) MUNITION WITH A VARIABLE EXPLOSIVE POWER

(71) Applicant: EURENCO, Massy (FR)

(72) Inventors: Bruno Nouguez, Villejuif (FR); Kamel Hammami, Jonquieres (FR); Luc Chaffois, Monteux (FR)

(73) Assignee: EURENCO, Massy (FR)

( * ) Notice: Subject to any disclaimer, the term of this patent is extended or adjusted under 35 U.S.C. 154(b) by 0 days.

(21) Appl. No.: 14/769,731

(22) PCT Filed: Feb. 27, 2014

(86) PCT No.: PCT/FR2014/050436

§ 371 (c)(1),
(2) Date: Aug. 21, 2015

(87) PCT Pub. No.: WO2014/132004

PCT Pub. Date: Sep. 4, 2014

(65) Prior Publication Data

US 2016/0003592 A1 Jan. 7, 2016

(30) Foreign Application Priority Data

Feb. 28, 2013 (FR) ..... 13 00454

(51) Int. Cl.
*F42C 14/06* (2006.01)
*F42B 12/20* (2006.01)
(Continued)

(52) U.S. Cl.
CPC ..... *F42B 12/208* (2013.01); *F42B 12/207* (2013.01); *F42B 25/00* (2013.01); *F42C 14/06* (2013.01); *F42C 19/0807* (2013.01); *F42C 19/0842* (2013.01)

(58) Field of Classification Search
CPC .... F42B 12/208; F42B 12/20; F42B 12/207; F42B 12/204; F42C 19/0842
See application file for complete search history.

(56) References Cited

U.S. PATENT DOCUMENTS 3,490,372 A * 1/1970 Lavine ..... F42B 1/00 102/305
4,391,195 A * 7/1983 Shann ..... F42B 3/113 102/201

(Continued)

FOREIGN PATENT DOCUMENTS

FR 2 896 577 A1 7/2007
WO WO 91/04235 A2 4/1991

(Continued)

OTHER PUBLICATIONS

English Translation of Search Report mailed on Jun. 10, 2014, in corresponding International PCT Application No. PCT/FR2014/050436, filed on Feb. 27, 2014 (2 pages).

*Primary Examiner* — Michael David
(74) *Attorney, Agent, or Firm* — Bookoff McAndrews, PLLC

(57) ABSTRACT

A munition (10) with variable explosive power comprises a body (12) extending in an axial direction and housing at least first and second explosive charges (31, 32), together with a firing device (16). According to the invention, the munition further comprises a selector (50, 50') provided with a detonating portion (52) and adapted to move between at least first and second positions, the selector being configured so that its detonating portion couples the firing device (16) to the first explosive charge in said first position and to the second explosive charge in said second position, one of the first and second explosive charges (31, 32) not being coupled to the firing device (16) in at least one of the first and second positions.

18 Claims, 3 Drawing Sheets

(51) Int. Cl.
*F42B 25/00* (2006.01)
*F42C 19/08* (2006.01)

(56) References Cited

U.S. PATENT DOCUMENTS 6,283,036 B1 9/2001 Munsinger
8,931,415 B2 * 1/2015 Volkmann ..... 102/217
9,267,774 B2 * 2/2016 Amon ..... F42B 12/06
2010/0199875 A1 * 8/2010 Weihrauch ..... F42B 12/208 102/492
2013/0042782 A1 * 2/2013 Haskins ..... F42B 12/207 102/478
2014/0338554 A1 * 11/2014 Treadway ..... F41A 1/00 102/379

FOREIGN PATENT DOCUMENTS

WO WO 2010/044716 A1 4/2010
WO WO 2011/135279 A1 11/2011

* cited by examiner

MUNITION WITH A VARIABLE EXPLOSIVE POWER

This application is the U.S. national phase entry under 35 U.S.C. §371 of International PCT Application No. PCT/FR2014/050436, filed on Feb. 27, 2014, which claims priority to French Patent Application No. FR 1300454, filed on Feb. 28, 2013, the entireties of each of which are incorporated by reference herein.

The present invention relates to a munition, in particular a bomb and more particularly an air bomb.

The present invention relates in particular to a munition of the type comprising a body extending in an axial direction and housing at least first and second explosive charges, together with a firing device.

More particularly, the present invention relates to a munition with variable explosive power.

In the present application, the term "munition with variable explosive power" means a munition capable of generating a detonation of predetermined non-zero power P1 in at least one first mode of operation, and of generating, in a second mode of operation, a detonation of non-zero power P2 that is different from P1, each of the powers P1 and P2 being estimated, for example, in terms of its TNT equivalent.

A munition of the above-specified type is generally designed to be connected to a bomb rack, in particular of an aircraft. It then constitutes an air weapon used for precision striking of targets on the ground such as bunkers, armored vehicles, etc.

Examples are already known of munitions having controllable or programmable explosive power, i.e. that are capable of releasing on demand either all or only some of their explosive energy, depending on the more or less armored nature of the target and of its close environment.

In the international application published under the number WO 2011/135279, there is disclosed a munition having two explosive charges arranged coaxially and connected to respective firing devices. Controlled initiation of only one or of both of the firing devices makes it possible to detonate either only one of the explosive charges or both of them, thereby controlling the explosive power of the munition. A drawback of such a munition is that it is necessary to manage two firing devices, and unfortunately most existing arming devices do not make that possible.

Application WO 2010/044716 discloses a munition having a plurality of stacked annular charges defining a central channel that receives a cylinder having vents, and that houses a firing device. In that device, the charges are initiated selectively by pivoting the cylinder so as to allow the gas generated by the firing device to pass to the selected charge(s). The presence of a central channel housing the firing device nevertheless limits the extent to which the munition can be filled with active material, and makes fabrication of the munition more complex.

The person skilled in the art thus continues to seek a munition, and in particular an air munition, that enables its explosive power to be adjusted easily.

The object of the present invention is to provide a novel munition satisfying those conditions.

This object is achieved by a munition with variable explosive power, the munition comprising a body extending in an axial direction and housing at least a first and a second explosive charge, together with a firing device, said munition being characterized in that it further comprises a selector provided with a detonating portion and adapted to move between at least a first and a second position, the selector being configured so that its detonating portion couples the firing device to the first explosive charge in said first position and to the second explosive charge in said second position, one of the first and second explosive charges not being coupled to the firing device in at least one of the first and second positions.

In the invention, the firing device is adapted to be coupled to each explosive charge via the detonating portion of the selector, which forms an initiation relay.

In the present application, the term "charge" designates a pyrotechnic load that is generally in the form of a block.

Furthermore, in the present application, two elements are said to be coupled when detonating one of them causes the second to be detonated.

Since the selector is movable, its detonating portion can couple the firing device to one or the other of the explosive charges, depending on its position, and in certain embodiments, it can couple it to both of them so that the detonation power of the munition can be modulated.

An armorer can select the power of the munition merely by acting on the selector when putting it into place (i.e. during mounting) and/or after it has been put into place, when making the munition operational as a function of the intended target.

The position of the selector on mounting is optionally predetermined (i.e. there may optionally be a default setting). However whatever its initial position after mounting, the selector can be moved prior to use in order to adapt, if required, the explosive power of the munition.

For this purpose, in an advantageous embodiment, the munition includes a drive system for connecting the selector to a movable actuator element forming a portion of the outer covering of the munition, the movement of said actuator element causing the movement of the selector. The drive system may comprise a rod, for example.

When the selector is in its first position, and the firing device is actuated, detonation is transmitted to the first explosive charge via the detonating portion of the selector.

In similar manner, when the selector is in its second position, and the firing device is actuated, detonation is transmitted to the second explosive charge via the detonating portion of the selector.

By means of the provisions of the invention, the munition of the invention therefore requires only one single triggering command, in other words one single firing device, in order to trigger the various explosive charges that it houses.

In certain circumstances, the detonating portion of the selector is coupled indirectly to one or the other of the explosive charges.

In an example, the munition includes at least one primary pyrotechnic transmission unit coupling the first explosive charge to the selector.

In an example, the munition also includes at least one secondary pyrotechnic transmission unit coupling the second explosive charge to the selector.

The pyrotechnic transmission units connected respectively to the first and second explosive charges may for example be radially opposite to one another, i.e. situated on opposite sides of the main axis of the munition.

In certain embodiments, in one of the first and second positions, the detonating portion of the selector is coupled simultaneously to both the first and second explosive charges (either directly or else via one or more pyrotechnic transmission units).

Under such circumstances, the selector triggers both explosive charges and the detonation power, when the selector is in said position, can correspond to the sum of the powers of the two explosive charges.

In another position, the selector triggers only one of the two charges.

In other embodiments, the detonating portion of the selector is not suitable for coupling the firing device simultaneously to both the first and the second explosive charges.

Under such circumstances, provision may be made for detonation of one of the explosive charges to give rise to initiation of the other explosive charge, either by direct sympathetic propagation (in particular if the explosive power of the charge is large), or else by means of one or more pyrotechnic transmission units.

In any event, the munition of the invention makes it possible to generate an explosion of predetermined non-zero power P1 in at least a first mode of operation (selector in a first position) and to generate an explosion of non-zero power P2 that is different from P1 in a second mode of operation (selector in a second position).

In the invention, the first and second explosive charges are configured so that at least one of the two charges can detonate without detonating the other. In general, this is made possible by adapting the explosive power of each charge. Parameters that enable this explosive power to be modulated include for example the nature of the charge, its dimensions, its shape, its intrinsic performances, its critical dimensions, and its sensitivity to intense impacts.

In an example, the first and second explosive charges are separated by a first non-detonating intermediate element.

The first non-detonating intermediate element may in particular be an inert charge (i.e. a non-pyrotechnic charge) or it may be an energetic charge that is non-detonating (i.e. a charge that can release energy by rapid combustion or deflagration).

In an example, the firing device is separated from the second explosive charge by a second non-detonating intermediate element.

The second non-detonating intermediate element may in particular be an inert charge or a charge that is energetic but non-detonating.

In the present application, the "front" end of the munition is the end facing in the travel direction of said munition, and the "rear" end is its axially opposite end.

In an advantageous example, the firing device is arranged at one end of the munition, in particular at its rear end.

Thus, by way of example, the firing device and the explosive charges are arranged one after another in the axial direction of the munition.

In an advantageous embodiment of the invention, the first explosive charge is arranged in the vicinity of the front end of the munition, and the second explosive charge is arranged axially between the firing device and the first explosive charge. When only the first explosive charge is caused to detonate, the blast effect and the fragments that result from the detonation are directed mainly forwards, i.e. towards the target, and collateral effects towards the rear of the munition are considerably reduced. This is advantageous in particular when targets are located in an urban environment. Under such circumstances, it is desirable not only to reduce the explosive power of the munition, but also to limit possible collateral effects, by directing the blast effect and the fragments generated by detonation towards the intended targets.

As mentioned above, in an example, the selector is configured in such a manner that its detonating portion couples the firing device to only one explosive charge at a time.

In another example, the selector is configured in such a manner that in at least one of the first and second positions, its detonating portion couples the firing device to both the first and the second explosive charges.

In an example, the selector is a rotary element having a first angular sector constituting the detonating portion and a second angular sector that is made of a non-detonating material.

In an example, the angular sector constituting the detonating portion extends over an angle of less than 180°, preferably lying in the range 30° to 150°, more preferably lying in the range 60° to 120°.

In another example, the angular sector constituting the detonating portion extends over an angle of not less than 180°, preferably lying in the range 210° to 330°, more preferably lying in the range 240° to 300°.

By way of example, the selector is a rotary ring.

Under such circumstances, and in a provision of the invention, the firing device is arranged in the inside space defined by the inside wall of the ring forming the selector.

In the present description, except where specified to the contrary, an axial direction is a direction parallel to the main axis of the munition. In addition, a radial direction is a direction perpendicular to the main axis and intersecting it. Unless specified to the contrary, the adjectives and adverbs "axial", "radial", "axially", and "radially" are used relative to the above-specified axial and radial directions. Likewise, an axial plane is a plane containing the main axis of the munition, and a radial plane is a plane perpendicular to that axis. Likewise, an axial section is a section defined in an axial plane and a radial section is a section defined in a radial plane.

In addition, except when specified to the contrary, the adjectives "inner" and "outer" are used relative to a radial direction such that the inner (i.e. radially inner) face or portion of an element is closer to the main axis than the outer (i.e. radially outer) face or portion of the same element.

In the present application, the term "pyrotechnic transmission unit" is used to cover any unit suitable for propagating a detonation, in particular from the detonating portion of the selector to the explosive charge, said elements being located spaced apart from each other.

The pyrotechnic transmission unit generally comprises a pyrotechnic extension serving to connect the selector to the corresponding explosive charge.

It should be understood that the term "pyrotechnic extension" is used to cover any element adapted to transmit a detonation wave coming initially from the firing device and without modifying said detonation wave, and in particular without modifying its surface amplitude, its intensity (or its power), or its shape.

Generally, a pyrotechnic extension is an elongate element, i.e. it is longer than it is wide, it may be rigid or flexible, and it is generally of substantially constant section.

The pyrotechnic extension preferably contains an explosive of homogeneous composition that is identical to or different from that of the explosive charge. In more preferred manner, the pyrotechnic extension contains a single explosive compound of homogeneous composition, in particular a monolithic compound. In still more preferred manner, the pyrotechnic transmission unit has a single explosive compound of homogeneous composition, that is preferably monolithic.

Preferably, the pyrotechnic extension presents a maximum radial dimension that is substantially smaller than the maximum diameter of the munition, preferably at least five times smaller than the diameter, and still more preferably at least 20 times smaller than the diameter.

In an example, the pyrotechnic transmission unit comprises a rigid or flexible and optionally rectilinear tube containing an explosive compound. A pyrotechnic transmission unit may in particular comprise a flexible detonating cord as described in patent application WO9104235. The pyrotechnic transmission unit may also comprise a tube containing a granular explosive charge (of RDX or HMX type) or a compressed explosive (of hexowax type) or indeed a composite explosive having a cross-linked binder (of the HMX or RDX and polyurethane binder type). The tube may be made of plastics material or out of metal.

In another element, the pyrotechnic transmission unit comprises a rigid cord of arbitrary shape made out of an explosive compound, said cord possibly being bare or covered with a liner.

In an advantageous embodiment, the pyrotechnic transmission unit further comprises a first initiation relay coupling said pyrotechnic extension to the corresponding explosive charge.

In the present application, the term "initiation relay" (or "booster") designates any initiation device suitable for transmitting a detonation wave while modifying the surface amplitude and/or the intensity and/or the shape of the wave.

By way of example, the initiation relay may serve to increase the area of the detonation wave transmitted to the explosive charge when the pyrotechnic extension presents a diameter smaller than the critical diameter of the explosive charge (i.e. the diameter beneath which detonation of the charge cannot take place). The initiation relay may then be a shape that is flared towards the explosive charge, its maximum diameter being greater than the critical diameter of said charge.

Several embodiments are described in the present description. Nevertheless, unless specified to the contrary, characteristics described with reference to any one embodiment may be applied to any other embodiment.

The invention can be well understood and its advantages appear better on reading the following detailed description of embodiments given in non-limiting manner. The description refers to the accompanying drawings, in which.

Figure 1:
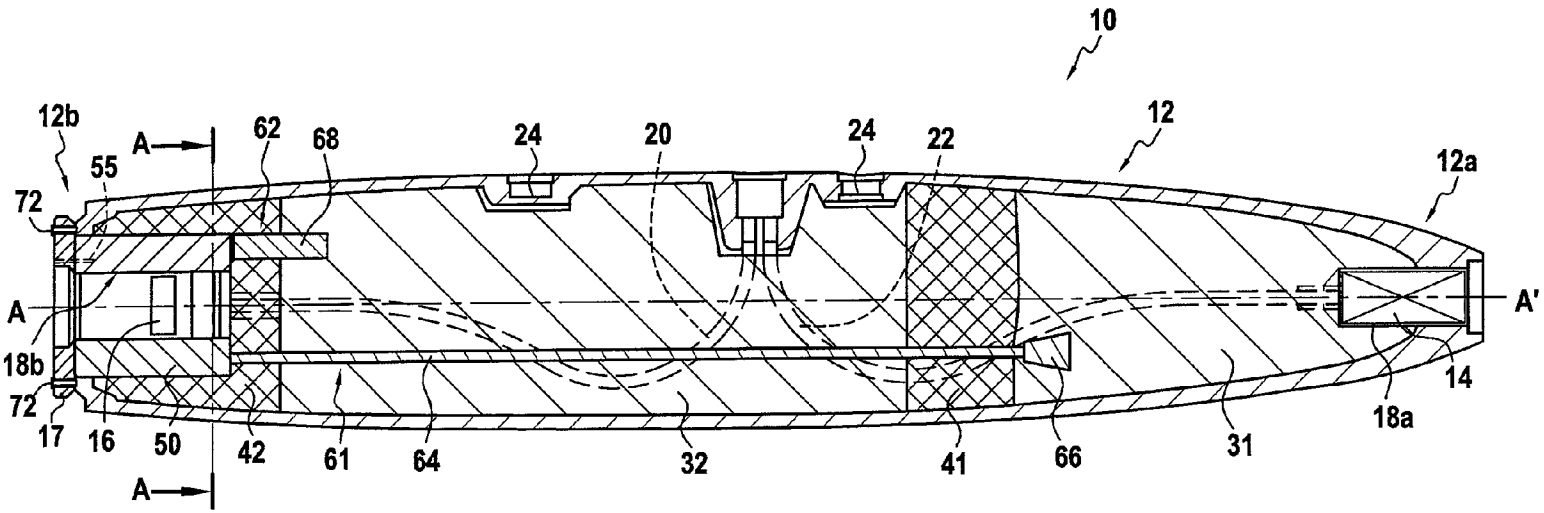
FIG. 1 is an axial section of a munition according to a first embodiment of the present invention.
Figure 6B:
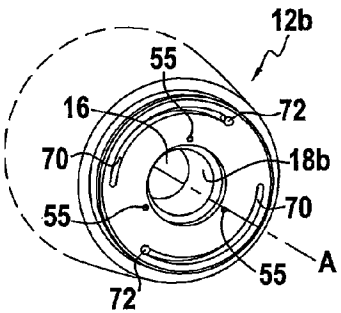
Figure 6A:
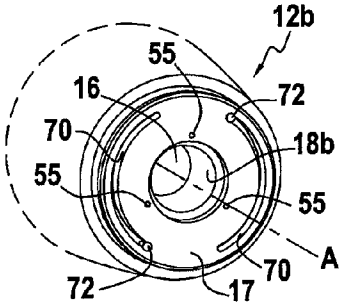
Figure 2:
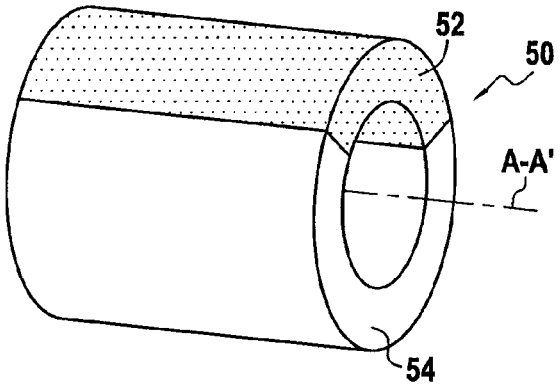
FIG. 2 shows a first example of a selector suitable for use in a munition as shown in FIG. 1.
Figure 3A:
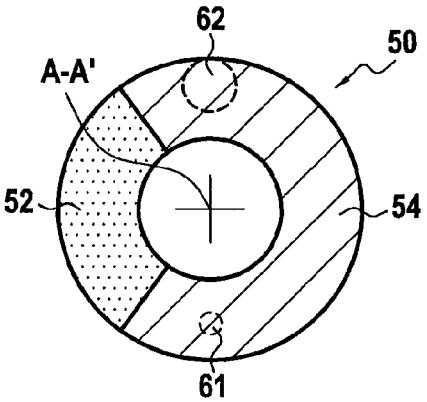
Figure 3B:
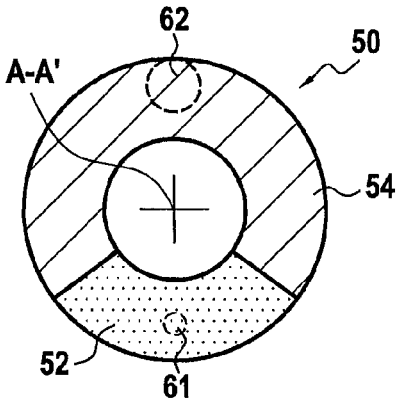
Figure 3C:
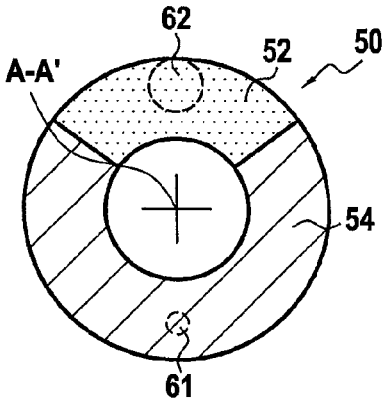
Figure 4:
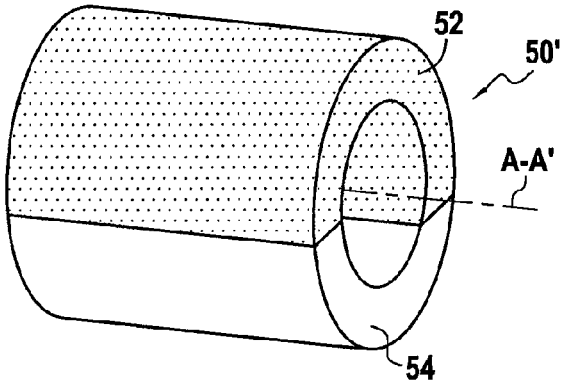
Figure 5A:
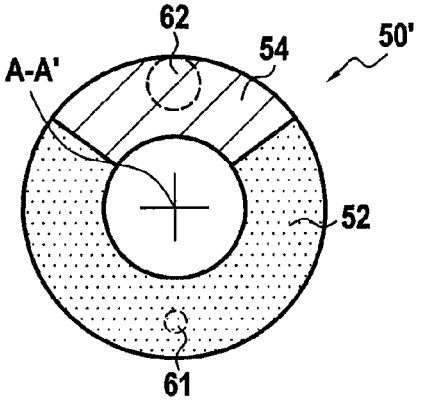
Figure 5B:
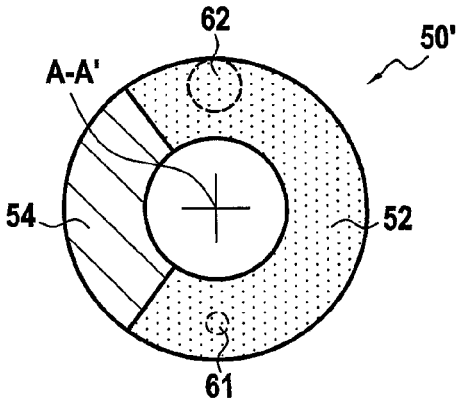

FIGS. 3A, 3B, and 3C show the FIG. 2 selector in different positions;

FIG. 4 shows a second example of a selector suitable for use in a munition as shown in FIG. 1;

FIGS. 5A and 5B show the FIG. 4 selector in different positions; and FIGS. 6A and 6B show the system for controlling the explosive power setting, at the rear of the munition.

FIG. 1 shows a munition 10 according to a first embodiment of the present invention, having an elongate body 12 of axis A-A'.

Throughout the present application, the term "front" is used for the end of the munition 10 facing in its direction of movement (i.e. towards the target), and the term "rear" designates the opposite end of the munition along the axis A-A'.

In the example, the body 12 tapers at its front end 12*a*.

As shown in FIG. 1, the body houses at its front end a functional housing 14 suitable for receiving a ballistic control member such as a kit for guiding the munition, or a proximity detector enabling the munition to be triggered in the proximity of the target. In this example, this functional element is arranged inside a front reception sheath 18*a* dimensioned to shut a front opening in the body.

A firing device 16 is situated in the vicinity of the rear end 12*b* of the body 12. In the example shown, the firing device 16 is inserted inside a reception sheath 18*b* provided at the rear end 12*b* of the body 12 (referred to below as the "rear" sheath).

As also shown in FIG. 1, the rear end 12*b* of the bomb body 12 is shut by a closure device 17 that holds the rear sheath 18*b* in position in the example described.

The functional element 14 and the firing device 16 are both powered by a power supply member (not shown) situated outside the body 12, with this taking place via electrical ducts 20, 22. By way of example, the power supply member may be a propeller, in particular a propeller turbine mounted on the outside of the body of the munition.

The munition 10 also has two anchor wells 24 formed in the body 12 enabling it to be connected to a bomb rack of the airplane, helicopter, or drone on which the munition 10 is to be mounted, for example. The wells 24 may in particular serve to receive rings for suspending the munition 10 from the bomb rack.

In the axial direction going from the front towards the rear of the munition, the body 12 houses in succession: a first explosive charge 31 that occupies a front first space of the munition 10 defined by the inside wall of the body 12 and the front sheath 18*a*, a first non-detonating intermediate element 41, a second explosive charge 32, a second non-detonating intermediate element 42, and the firing device 16.

In FIG. 1, it can be seen that in this example each explosive charge 31, 32 is constituted by a solid block. Each charge thus extends substantially over an entire diameter of the body 12.

By way of example, the first and second explosive charges 31 and 32 may be constituted by a composite explosive, in particular based on aluminum (Al), hexogen (RDX), and a polyurethane binder. An example of a composition that is suitable for use is the composition having the reference PBXN-109. Nevertheless, any other appropriate composition could be used. It should be observed that the explosive charges of the munition may present compositions that are either identical or else different.

The first and second non-detonating intermediate elements 41 and 42 in this example are non-detonating charges that may be inert or non-detonating energetic.

These charges may present compositions that are similar or different. A plastics material, in particular a polyurethane matrix material with a mineral filler constitutes an example of a suitable composition.

In very approximate manner, it can be considered in this example that the first and second explosive charges 31 and 32 occupy respectively one-fourth and one-half of the inside space of the body of the munition. Each of the non-detonating charges 41 and 42 occupies a respective approximately ⅛ of the inside space.

In FIG. 1, it can be seen that the firing device 16 is surrounded by a selector 50 that is in the form of a rotary ring in this example, the selector 50 itself being surrounded by the second non-detonating charge 42.

As described in greater detail below with reference to FIGS. 2 and 4 in particular, the selector 50 has at least one portion 52 constituted by an explosive material that is suitable for propagating a detonation coming from the firing device 16.

The selector 50 is also adapted to pivot about the axis A-A' of the body 12 of the munition 10 in order to couple the detonating portion 52 with the desired explosive charge(s), thereby modulating the explosive power of the munition depending on requirements.

According to the invention, each explosive charge 31, 32 is pyrotechnically connected (i.e. coupled) to the selector 50 via at least one pyrotechnic transmission unit 61, 62.

A pyrotechnic transmission unit 61 coupling the first explosive charge 31 to the selector 50 is referred to as the primary pyrotechnic transmission unit. In this example it passes through a portion of the second intermediate element 42.

A pyrotechnic transmission unit 62 coupling the second explosive charge 32 to the selector 50 is referred to as the secondary pyrotechnic transmission unit. In this example it passes through a portion of the second intermediate element 42, the second explosive charge 32, and the first intermediate element 41.

In the example shown, only one primary transmission unit 61 and one secondary transmission unit 62 are provided.

In variant embodiments, there may be a plurality of primary pyrotechnic transmission units 61 and/or a plurality of secondary pyrotechnic transmission units 62.

In this example, the primary and secondary pyrotechnic transmission units 61 and 62 are arranged symmetrically on either side of the axis A-A' and each of them extends parallel to the axis.

Naturally, they may present sections and shapes that are different.

In this example, the primary pyrotechnic transmission unit 61 comprises a pyrotechnic extension 64 connected directly to the selector 50, and an initiation relay 66 connected to the first explosive charge 31.

As shown in FIG. 1, the pyrotechnic extension 64 passes through the second non-detonating charge 42, the second explosive charge 32, and the first non-detonating charge 41. It should be observed that the primary pyrotechnic transmission unit, and in particular the portion of said pyrotechnic transmission unit that is in contact with the second explosive charge (in particular the pyrotechnic extension 64) is configured in such a manner that the propagation of an explosive wave in said unit does not initiate the second explosive charge. This is made possible by the fact that the second explosive charge, given its sensitivity to detonation initiation (associated with its nature, its dimensions, its shape, its intrinsic performance, its critical dimensions, and its sensitivity to intense impacts, . . . ), is not capable of being initiated in detonation by the radial effects of detonation of the pyrotechnic transmission unit, or at least of its portion in contact with said second explosive charge.

For this purpose, the pyrotechnic transmission unit may for example have an outer sheath that preferably extends over the entire periphery of the transmission unit, and that is made in particular of an inert material that surrounds the explosive material serving to propagate the detonation.

In the example shown, the pyrotechnic extension 64 and the initiation relay 66 thus comprise an outer sheath made of metal or of plastics material and that is filled with an explosive compound serving to transmit the detonation of the firing device 16 to the explosive charge 31.

In the example shown, the initiation relay 66 is frustoconical in shape, being flared towards its free end, thereby enabling the detonation coming from the firing device 16 to be transmitted effectively to the explosive charge 31.

Still in this example, at least one end of the pyrotechnic transmission unit 61, and in particular the initiation relay 66, is embedded in the first explosive charge 31.

In the example shown, the secondary pyrotechnic transmission unit 62 is constituted by an extension 68 of constant section and of length that is naturally much shorter than that of the primary pyrotechnic transmission unit, with its end embedded in the second explosive charge 32.

In a variant (not shown), one or each pyrotechnic transmission unit may be separated from the corresponding explosive charge by a layer of inert material, in particular an inert material forming a portion of the non-detonating charge through which the transmission unit passes. Under such circumstances, the thickness of the layer of non-detonating material is thin enough to ensure that the detonation initiated by the firing device can propagate sympathetically from the pyrotechnic transmission unit to the corresponding explosive charge. The thickness of the layer of inert material preferably does not exceed 30 millimeters (mm).

In another variant (not shown), the end of the pyrotechnic transmission unit, in particular an initiation relay forming said end, may be connected to the explosive charge merely by being pressed against a free surface of said explosive charge.

In yet another variant (not shown), the end of the pyrotechnic transmission unit, in particular an initiation relay forming said end, may also be adhesively bonded to the explosive charge by a layer of adhesive arranged between the surface of the explosive charge and a surface of the end relay, in particular its end surface which in this example is of greater section.

An example of a selector 50 suitable for use in the munition 10 of FIG. 1 is shown in FIG. 2.

In this example, the selector 50 is a rotary ring having a first angular sector 52 made of an explosive material (referred to below as the detonating portion), and a second angular sector 54 made of a non-detonating material, and in particular of an inert material (referred to below as the non-detonating portion), the first angular sector extending over an angle of less than 180°, in particular an angle lying in the range 30° to 150°, and more preferably in the range 90° to 120° (see FIG. 2, for example).

As can be seen in FIG. 1, the selector is secured to a closure plate 17 forming a portion of the outer covering of the munition, and in particular its rear end. The selector and the plate 17 are secured together in this example by rods 55.

By means of these provisions, an armorer acting on the plate 17 causes the selector 50 to turn simultaneously about the axis A-A', thereby setting the position of its detonating portion 52.

The plate 17 is shown in greater detail in FIGS. 6A and 6B, where it can be seen that it includes two curved oblong slots 70.

From these figures and from FIG. 1, it can be understood that the slots are for co-operating with pegs 72 secured to the body 12 of the munition and forming indicators of the angular position of the selector 50. For example, each peg 72 is arranged to come into abutment against one end of the corresponding oblong slot when the selector 50 is in a determined angular position corresponding to one power setting of the munition, and it may come into abutment against the opposite end of the slot when the selector 50 is in a second position corresponding to a different power setting.

By observing the positions of the pegs 72 in the slots, the armorer can thus easily determine the power setting of the munition.

It can be understood that the detonating portion 52 of the selector 50 constitutes an initiation relay that increases the area of the detonation wave coming from the firing device 16 in order to guarantee good subsequent transmission of the wave to the pyrotechnic transmission unit 61, 62 with which it is coupled.

FIG. 3A shows the selector 50 in a position in which the detonating portion 52 is angularly offset from each of the primary and secondary pyrotechnic transmission units 61 and 62. In this position, the firing device 16 is pyrotechnically connected to neither of the explosive charges 31 and 32. The munition 10 can thus be said to be deactivated.

FIG. 3B shows the selector 50 in a position in which the detonating portion 52 is situated facing the primary pyrotechnic transmission unit 61. The two transmission units 61 and 62 are radially opposite to one another with respect to the axis A-A' and the angular sector of the detonating portion 52 of the selector is too small to enable said detonating portion 52 to be pyrotechnically connected simultaneously with the secondary pyrotechnic transmission unit 62.

Consequently, in this position, if the firing device 16 is actuated, then the detonation is transmitted by the selector 50 solely to the first explosive charge 31.

The propagation of the detonation wave through the primary pyrotechnic transmission unit 61 does not lead to the second explosive charge 32 detonating, for the reasons mentioned above.

Since the primary explosive charge is arranged at the front of the munition, the blast effect and the fragments resulting from the detonation are directed mainly forwards, i.e. towards the target, and collateral effects towards the rear of the munition are considerably reduced.

FIG. 3C shows the selector 50 in a position in which its detonating portion 52 is situated facing the secondary pyrotechnic transmission unit 62.

In this position, if the firing device 16 is actuated, the detonation is transmitted by the selector 50 solely to the second explosive charge 32.

In the embodiment shown, the detonation of the second explosive charge is transmitted to the first explosive charge 31 either by direct sympathetic propagation, or else by means of the primary pyrotechnic transmission unit 61. This corresponds to all of the explosive charge contained in the munition 10 detonating, and thus to said munition having its maximum effect.

FIG. 4 shows a selector 50' in another embodiment, which differs from that of FIG. 2 in that the angular selector 52 of the rotary ring made of explosive material extends over an angle greater than 180°, preferably lying in the range 210° to 330°, and more preferably in the range 240° to 270°.

In other words, in this example, the active portion 52 of the selector 50 is defined so that, in a certain angular position, it can initiate both of the pyrotechnic transmission units 61 and 62 simultaneously.

FIG. 5A shows the selector in a position in which the active portion 52 is coupled solely to the primary pyrotechnic transmission unit. This configuration is entirely similar to that of FIG. 3B. If the firing device 16 is actuated, the selector 50' transmits detonation solely to the first explosive charge 31. The blast effect and the fragments resulting from the detonation of the primary charge are directed mainly forwards, and collateral effects towards the rear of the munition are reduced.

FIG. 5B shows the selector in a position in which its active portion simultaneously initiates both the primary and the secondary pyrotechnic transmission units. The entire explosive charge contained in the munition 10 is initiated simultaneously. The explosive power of the munition is at its maximum.

The invention claimed is:

1. A munition with variable explosive power, the munition comprising a body extending in an axial direction and housing at least a first and a second explosive charge, together with a firing device, wherein said munition further comprises a selector provided with a detonating portion and adapted to move between at least a first and a second position, the selector being configured so that its detonating portion couples the firing device to the first explosive charge in said first position and to the second explosive charge in said second position, one of the first and second explosive charges not being coupled to the firing device in at least one of the first and second positions, wherein the selector is a rotary element having a first angular sector constituting the detonating portion and a second angular sector that is made of a non-detonating material.

2. A munition according to claim 1, wherein the first and second explosive charges are separated by a first non-detonating intermediate element.

3. A munition according to claim 1, wherein the first explosive charge is arranged in the vicinity of a front end of the munition, and the second explosive charge is arranged in the axial direction of the munition between the firing device and the first explosive charge.

4. A munition according to claim 3, wherein the firing device is separated from the second explosive charge by a second non-detonating intermediate element.

5. A munition according to claim 1, further including at least one primary pyrotechnic transmission unit coupling the first explosive charge to the selector.

6. A munition according to claim 1, further including at least one secondary pyrotechnic transmission unit coupling the second explosive charge to the selector.

7. A munition according to claim 5, further including at least one secondary pyrotechnic transmission unit coupling the second explosive charge to the selector, wherein the primary pyrotechnic transmission unit and the secondary pyrotechnic transmission unit are radially opposite to one another.

8. A munition according to claim 1, wherein the selector is configured in such a manner that its detonating portion couples the firing device to only one explosive charge at a time.

9. A munition according to claim 1, wherein the selector is configured in such a manner that in at least one of the first and second positions, the detonating portion couples the firing device to both the first and the second explosive charges.

10. A munition according to claim 1, wherein the selector is a rotary ring.

11. A munition according to claim 1, wherein the first angular sector constituting the detonating portion extends over an angle of less than 180°.

12. A munition according to claim 1, wherein the first angular sector constituting the detonating portion extends over an angle of not less than 180°.

13. A munition according to claim 1, further including a drive system for connecting the selector to a movable actuator element forming a portion of an outer covering of the munition, the movement of said actuator element causing the movement of the selector.

14. A munition according to claim 1, wherein each of the first and second explosive charges occupy substantially an entire diameter of the body.

15. A munition according to claim 11, wherein the first angular sector constituting the detonating portion extends over an angle lying in the range 30° to 150°.

16. A munition according to claim 11, wherein the first angular sector constituting the detonating portion extends over an angle lying in the range 90° to 120°.

17. A munition according to claim 12, wherein the first angular sector constituting the detonating portion extends over an angle lying in the range 210° to 330 °.

18. A munition according to claim 12, wherein the first angular sector constituting the detonating portion extends over an angle lying in the range 240° to 270°.

* * * * *